US012396598B2

(12) United States Patent
Stout

(10) Patent No.: US 12,396,598 B2
(45) Date of Patent: Aug. 26, 2025

(54) FLEXIBLE SHOWER DAM

(71) Applicant: KOHLER CO, Kohler, WI (US)

(72) Inventor: Kenneth L. Stout, Sheboygan Falls, WI (US)

(73) Assignee: KOHLER CO., Kohler, WI (US)

( * ) Notice: Subject to any disclaimer, the term of this patent is extended or adjusted under 35 U.S.C. 154(b) by 172 days.

(21) Appl. No.: 18/340,385

(22) Filed: Jun. 23, 2023

(65) Prior Publication Data

US 2024/0016345 A1 Jan. 18, 2024

Related U.S. Application Data

(60) Provisional application No. 63/389,101, filed on Jul. 14, 2022.

(51) Int. Cl.
*A47K 3/40* (2006.01)

(52) U.S. Cl.
CPC ..... *A47K 3/40* (2013.01)

(58) Field of Classification Search
CPC ..... A47K 3/40; A47K 3/405; E06B 1/70
See application file for complete search history.

(56) References Cited

U.S. PATENT DOCUMENTS

| | | | | |
|---|---|---|---|---|
| 5,001,865 | A * | 3/1991 | Procton | E06B 1/70 49/489.1 |
| 6,094,757 | A * | 8/2000 | Torres | A47K 3/40 49/467 |
| 7,055,188 | B2 | 6/2006 | Ross et al. | |
| 9,895,032 | B2 | 2/2018 | Iannucci | |
| 10,028,623 | B1 * | 7/2018 | Smith | A47K 3/405 |
| 10,772,471 | B2 * | 9/2020 | Fine | A47K 3/286 |
| 2013/0239319 | A1 | 9/2013 | Serina et al. | |

* cited by examiner

*Primary Examiner* — Janie M Loeppke
(74) *Attorney, Agent, or Firm* — FOLEY & LARDNER LLP

(57) ABSTRACT

A shower dam assembly for mitigating water egress from a shower receptor includes a shower dam base and a shower dam. The shower dam base is coupled to a shower receptor and includes a groove extending along at least a portion of the shower dam base. The shower dam includes a shower dam insert and a flexing portion. The shower dam insert is configured to be received within the groove to removably couple the shower dam to the shower dam base. The flexing portion extends from the shower dam insert and is configured to flex between a normal position in which the flexing portion extends at least partially upward from the shower dam insert and a flexed position in which the flexing portion extends from the shower dam insert at an angle relative to the normal position.

20 Claims, 8 Drawing Sheets

FLEXIBLE SHOWER DAM

CROSS-REFERENCE TO RELATED PATENT APPLICATIONS

This application claims the benefit of and priority to U.S. Provisional Patent Application No. 63/389,101, filed Jul. 14, 2022, which is hereby incorporated by reference in its entirety.

BACKGROUND

The present disclosure relates generally to shower dams for the use in shower environments.

Shower dams are often installed to shower receptors to prevent water egress out of the shower environment. Conventional shower dams are rigidly secured to the shower receptor via silicone or pressure sensitive adhesive. The rigid connection formed between the shower dam and the shower receptor causes high stress areas when the shower dam is flexed. As a result, conventional shower dams are easily broken and/or need replacing.

SUMMARY

One example embodiment relates to a shower receptor. The shower receptor includes a shower dam assembly configured to prevent water egress from the shower receptor. The shower dam assembly includes a shower dam base and a shower dam. The shower dam base is coupled to an edge of the shower receptor. The shower dam base includes a groove extending along a portion of the shower dam base. The shower dam includes a shower dam insert, a flexing portion and a sealing portion. The shower dam insert is configured to be received within the groove. The flexing portion extends from the shower dam insert. The sealing portion extends from the shower dam insert and seals an area between the shower receptor and the shower dam.

Another example embodiment relates to a shower dam. The shower dam is selectively repositionable between a normal position and a flexed position. The shower dam assembly includes a shower dam base and a shower dam. The shower dam base is coupled to an edge of the shower receptor. The shower dam base includes a groove extending along a portion of the shower dam base. The shower dam includes a shower dam insert, a flexing portion and a sealing portion. The shower dam insert is configured to be received within the groove. The flexing portion extends from the shower dam insert. The sealing portion extends from the shower dam insert and seals an area between the shower receptor and the shower dam. The flexing portion is in an upright position when the shower dam is in the normal position. The flexing portion is in an angled position when the shower dam is in the flexed position.

This summary is illustrative only and is not intended to be in any way limiting. Other aspects, inventive features, and advantages of the devices or processes described herein will become apparent in the detailed description set forth herein, taking in conjunction with the accompanying figures, wherein like reference numerals refer to like elements.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Figure 1:
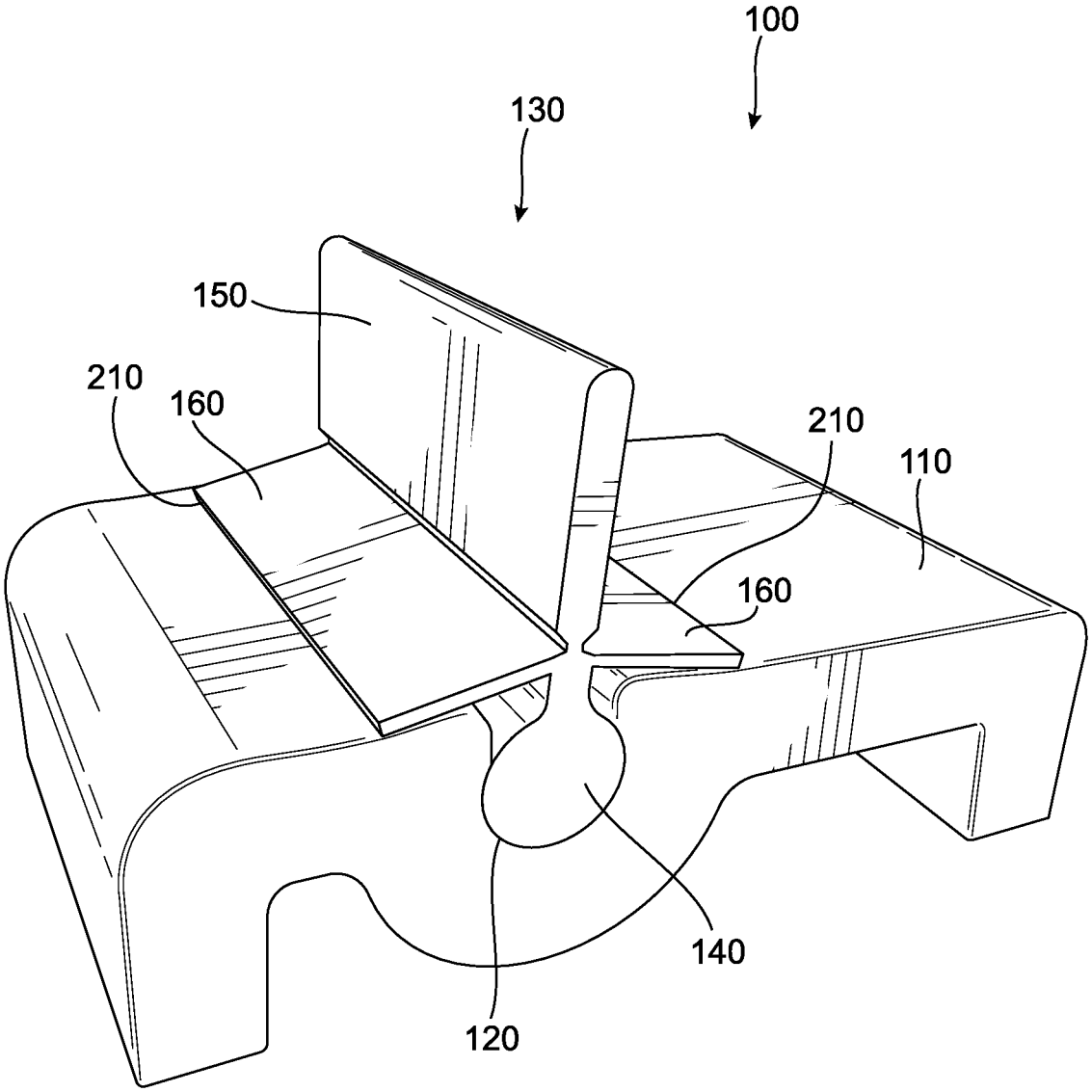
FIG. 1 is a perspective view of a shower dam assembly, shown in a normal position, according to an exemplary embodiment.

Before turning to the FIGURES, which illustrate certain example embodiments in detail, it should be understood that the present disclosure is not limited to the details or methodology set forth in the description or illustrated in the figures. It should also be understood that the terminology used herein is for the purpose of description only and should not be regarded as limiting.

Referring generally to the FIGURES, a shower dam assembly may be configured for use in a shower environment. The shower dam assembly may include a shower dam base that is coupled to and/or integrally formed within a shower receptor. The shower dam base may include a groove extending along a length of the shower dam base. The shower dam assembly may further include a shower dam configured to prevent water egress out of the shower receptor. The shower dam may include a shower dam insert that is received within the groove. The shower dam insert may define a substantially similar geometry to the groove such to create a snug fit within. The shower dam insert may be pivotably provided within the groove. That is, the shower dam insert may rotate within the groove when a force is introduced to the shower dam.

The shower dam may further include a flexing portion that extends upward from the shower dam insert. The flexing portion may be repositionable between a normal position and an angled position. The flexing portion may be flexible on either side of the shower dam depending on the force introduced to the flexing portion. When the flexing portion is in the normal position, the flexing portion is positioned substantially perpendicular to the shower receptor. When the flexing portion is in the angled position, the flexing portion may be positioned angularly from the flexing portion.

The shower dam may further include two sealing portions extending substantially perpendicular to the flexing portion. The sealing portions may be configured to seal an area between the shower dam and the shower receptor.

Referring generally to FIGS. 1-8, a shower dam assembly 100 is shown, according to an exemplary embodiment. The shower dam assembly 100 may be configured for use in a shower environment. In other embodiments, the shower dam assembly 100 may be configured for use in an alternate embodiment (e.g., bathroom environment, kitchen environment, industrial environment, etc.). The shower dam assembly 100 may be positioned proximate a bottom of the shower environment. More particularly, the shower dam assembly 100 may be integrally formed within a shower receptor. In other embodiments, the shower dam assembly 100 may be formed as a separate component that is assembled on and/or next to the shower receptor. The shower dam assembly 100 may be configured to prevent water egress out of the shower environment. For example, the shower dam assembly 100 may prevent water that is captured within the shower receptor from egressing out via the shower dam assembly 100.

The shower dam assembly 100 may include a shower dam base 110. The shower dam base 110 may be integrally formed within the shower receptor. That is, the shower dam base 110 may be integrally formed within a threshold of the shower receptor so that the top surface of the shower dam base is substantially flush with the floor of the shower receptor. The floor of the shower receptor may have depressions/grooves cut into it so that the shower dam base 110 may fit into the floor of the shower receptor. The shower dam base 110 may be press fit into the floor of the shower receptor. In other embodiments, the shower dam base 110 may be secured into the floor of the shower receptor by the use of fasteners (bolts, nails, screws, etc.). In other embodiments, the floor of the shower receptor itself may form the shower dam base 110 by having a groove formed within the floor of the shower receptor. The groove in the floor of the shower receptor may act like groove 120 in the shower dam base 110. In other embodiments, the shower dam base 110 may be a separate component that is coupled to the shower receptor upon installation. As can be appreciated, the shower dam base 110 may positioned along an entire length of a side of the shower receptor, between the shower receptor and the bathroom environment. In other embodiments, the shower dam base 110 may be positioned along a portion of the shower receptor where water is most likely to build up or individuals are most likely to ingress or egress from. The shower dam base 110 may include a groove, cavity, slot, or the like, shown as groove 120. The groove 120 may extend along at least a portion of the length of the shower dam base 110. That is, the groove 120 may extend along an entire length of the shower dam base 110. The groove 120 may form a substantially cylindrical shape. Additionally or alternatively, the groove 120 may form any other shape.

Figure 2A:
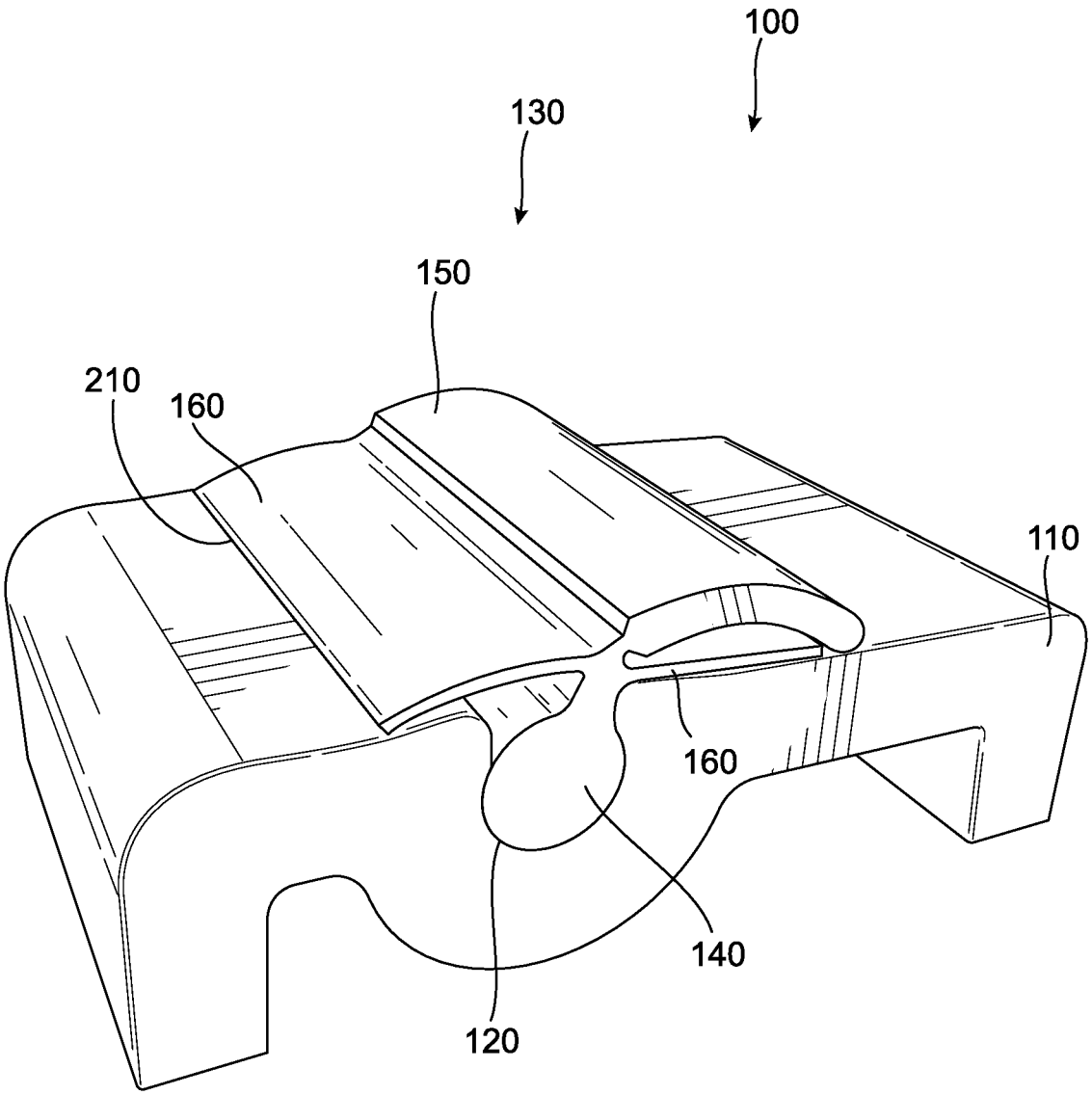
FIG. 2A is a perspective view of the shower dam assembly of FIG. 1, shown in a flexed position, according to an exemplary embodiment.
Figure 2B:
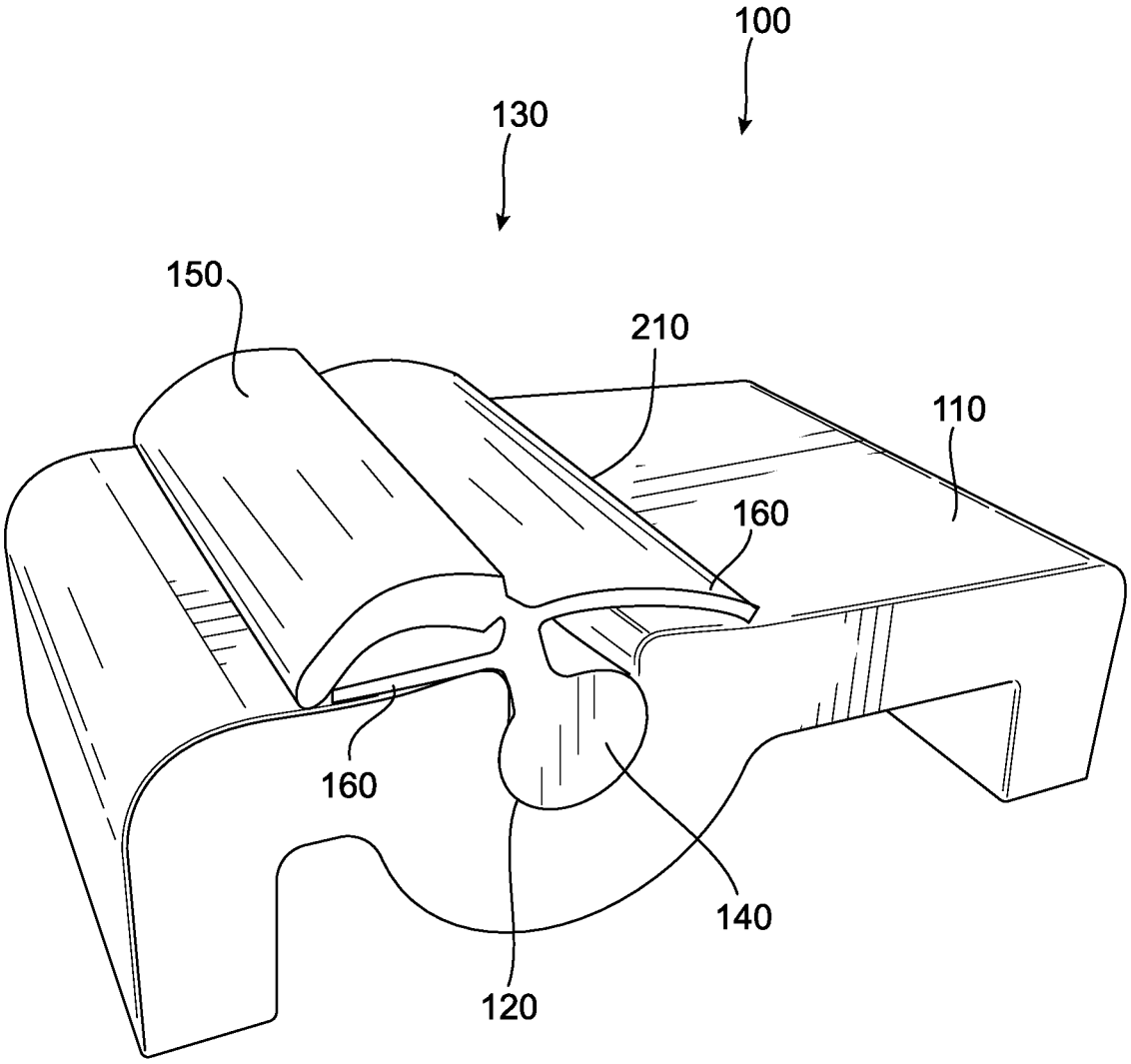
FIG. 2B is a perspective view of the shower dam assembly of FIG. 1, shown in a second flexed position, according to an exemplary embodiment.)
Figure 3:
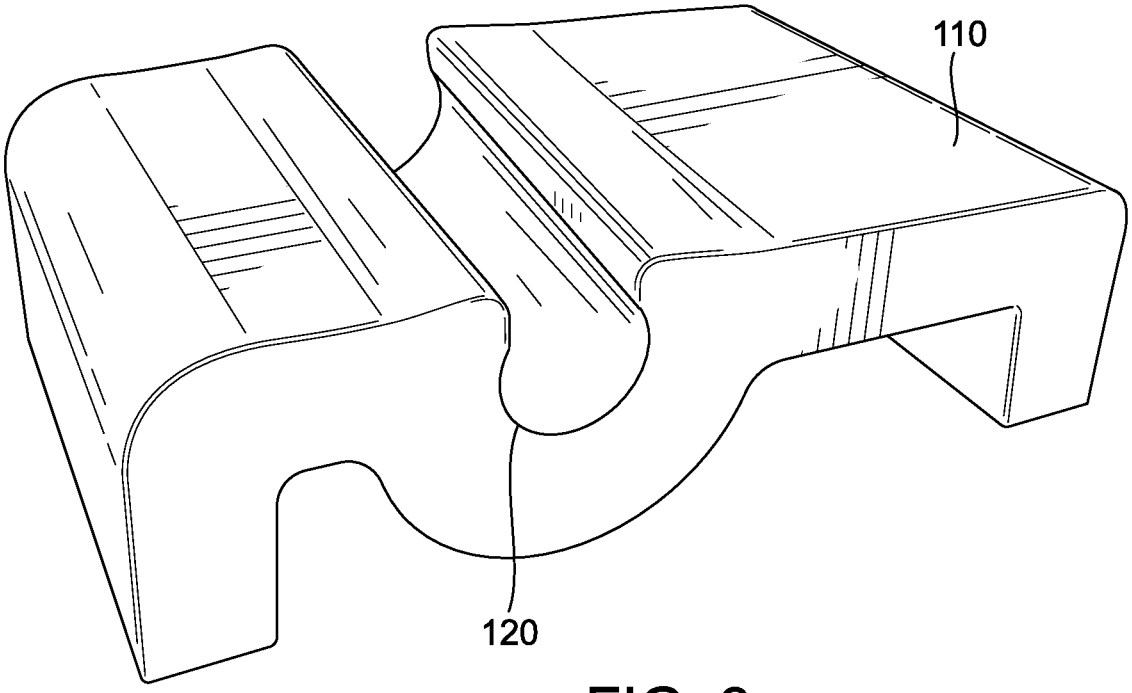
FIG. 3 is a perspective view of a shower dam base of FIG. 1, according to an exemplary embodiment.
Figure 4:
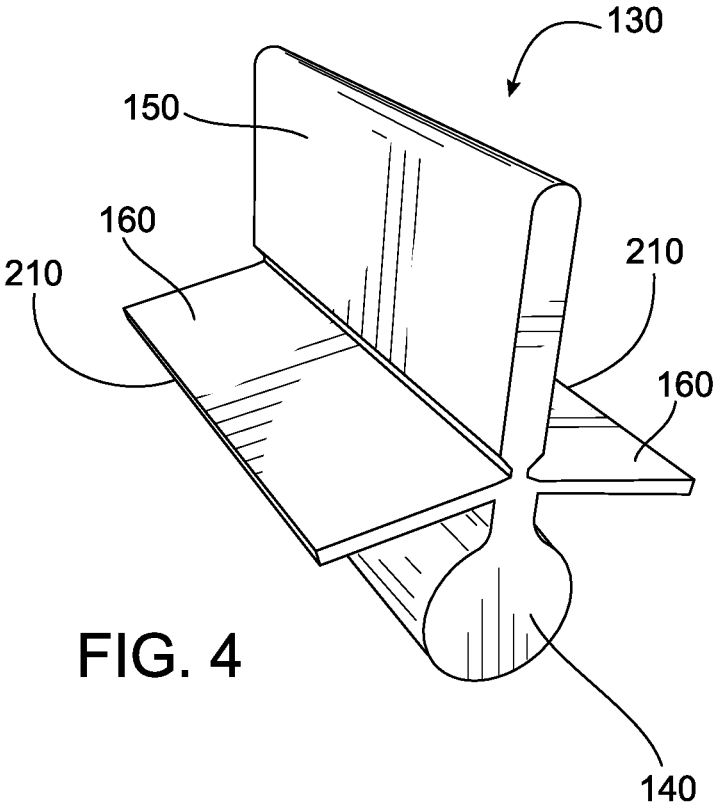
FIG. 4 is a perspective view of a shower dam of FIG. 1, according to an exemplary embodiment.

The groove 120 may be configured to receive a shower dam 130. The shower dam 130 may be a flexible shower dam that is able to flex into and out of the shower receptor. That is, the shower dam 130 may be configured for applications where a user may need to step on, or otherwise abut the shower dam 130. In some embodiments, the user may need a wheelchair or assist within the shower environment, where the user will not be able to lift the wheelchair or assist over the shower dam 130, subsequently leading to the shower dam 130 being flexed into a flat position. The shower dam 130 may be manufactured out of a silicone or rubber material to allow the shower dam 130 to flex (e.g., elastically bend or deform) and elastically recover back into position. The shower dam 130 may be selectively repositionable between a normal position (e.g., as shown in FIG. 1) and a flexed position (e.g., as shown in FIG. 2A). When the shower dam 130 is in the normal position, water egress from the shower receptor may be prohibited. Accordingly, when the shower dam 130 is in the flexed position, water egress from the shower receptor may be permitted. Additionally or alternatively, when the shower dam 130 is in the flexed position, water egress from the shower receptor may be prohibited when the water is below a certain threshold (e.g., below the height of the shower dam 130 when in the flexed position). The shower dam 130 may also be selectively repositionable between the normal position and a second flexed position in a direction opposite the flexed position as shown in FIG. 2B. Accordingly, the shower dam 130 may be able to rotate in both a clockwise and counterclockwise direction. In some embodiments, when the user may need a wheelchair or assist within the shower environment, where the user will not be able to lift the wheelchair or assist over the shower dam 130, the shower dam 130 may flex into a flat position in both a clockwise and counterclockwise direction. This may allow a user to not only more easily enter the shower environment, but also more easily exit the shower environment.

The shower dam 130 may include a bulbous portion, shown as shower dam insert 140. The shower dam insert 140 may be received within the groove 120 to couple the shower dam 130 to the shower dam base 110. The shower dam insert 140 may define a substantially similar geometry to the groove 120 to create a snug fit between the shower dam base 110 and the shower dam 130. For example, if the groove 120 defines a substantially annular geometry, the shower dam insert 140 may also define a substantially annular geometry. In another example, if the groove 120 defines a substantially rectangular geometry, the shower dam insert 140 may also define a substantially rectangular geometry. As can be appreciated, the groove 120 and the shower dam insert 140 may define any geometry that is suitable for the shower dam assembly 100 (e.g., triangular, prismatic, frustoconical, etc.). In other embodiments, the groove 120 may define a different geometry than the shower dam insert 140.

Figure 7:
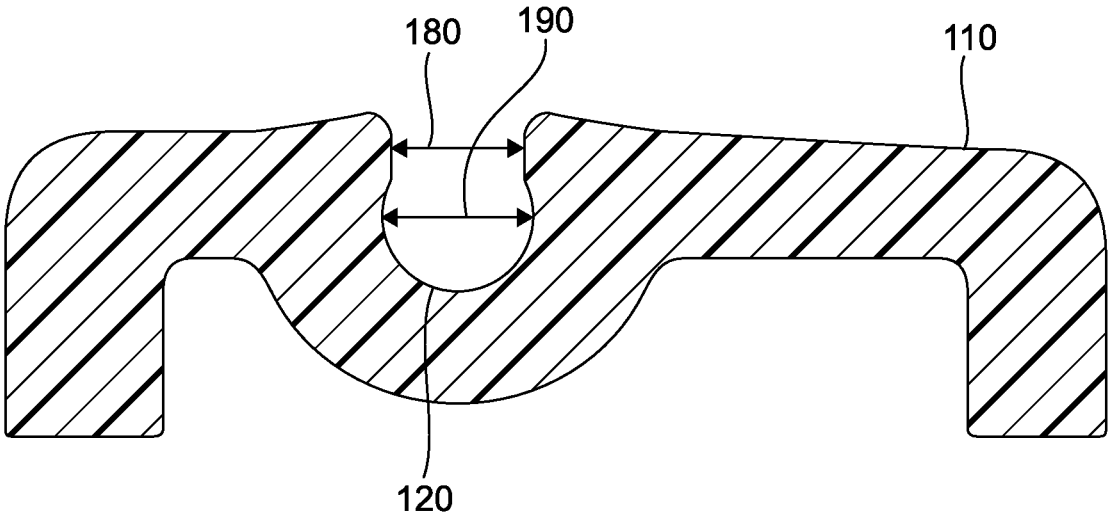
FIG. 7 is a cross-sectional view of the shower dam base of FIG. 1, according to an exemplary embodiment.

To install the shower dam insert 140 within the groove 120, the shower dam insert 140 may be inserted via a press force. For example, a user can press the shower dam insert 140 into the groove 120 in a direction substantially perpendicular to a longitudinal axis of the groove 120 (e.g., by applying downward force), causing the shower dam insert 140 to compress or otherwise elastically deform when moving into the groove 120 via the relatively narrower opening 180 along the top of the groove 120. As shown in FIG. 7, the groove 120 has a groove diameter 190 that is larger than the opening 180 of the groove 120. Therefore, the shower dam insert 140 may compress or elastically deform when moving into the groove 120 through the narrower opening 180 in order to fit securely and seat properly in the groove 120. The shower dam base 110 may be made of the same or similar elastic material as other components of the shower dam 130, thereby allowing the shower dam base 110 to elastically deform when the shower dam insert 140 moves through the narrower opening 180 of the groove 120 and recover when the shower dam insert 140 is seated within the groove 120 back to its original size and shape to securely hold the shower dam insert 140 within the groove 120. In another embodiment, both the shower dam insert 140 and the shower dam base 110 may be made of elastic material so that both the shower dam insert 140 and the shower dam base 110 may elastically deform when the shower dam insert 140 moves through the narrower opening 180 of the groove 120. Both the shower dam insert 140 and the shower dam base 110 would recover to their original size and shape once the shower dam insert 140 is seated properly within the groove 120. To uninstall the shower dam insert 140 from the groove 120, the shower dam insert 140 may be uninstalled via a pull force. Similarly to installing the shower dam insert 140 into the groove, the shower dam insert 140 may exit through the narrow opening 180 and may elastically deform.

The shower dam base 110 may additionally or alternatively deform as the shower dam insert 140 is removed through the narrow opening 180.

The shower dam 130 may further include a flexing portion 150. The flexing portion 150 may extend upward from the shower dam insert 140. Extending upward may include extending straight upward or partially upward but at an angle (e.g., 5 degrees, 20 degrees, 45 degrees, etc.) relative to straight upward. In other embodiments, the flexing portion 150 may extend upward from a location offset the shower dam insert 140. The flexing portion 150 may be configured to prevent water egress from the shower receptor by extending upward and forming a barrier between the shower receptor and the shower environment. The flexing portion 150 may selectively reposition relative to a location proximate the shower dam insert 140. For example, when the shower dam 130 is in the normal position, the flexing portion 150 may be in an upright (e.g., normal, etc.) position, where the flexing portion 150 extends upward from the shower dam insert 140. Specifically, when the shower dam 130 is in the normal position, the flexing portion 150 may be positioned substantially perpendicular to the shower receptor. In another example, when the shower dam 130 is in the flexed position or the second flexed position, the flexing portion 150 may be angularly positioned relative to the shower dam insert 140. The angular position of the flexing portion 150 may be based upon an outside force introduced to the flexing portion 150. For example, the greater the outside force on the flexing portion 150 results in a greater angle of the flexing portion 150 relative to the normal position. Additionally, the direction of the outside force on the flexing portion 150 may determine which direction the flexing portion 150 rotates. The flexing portion 150 may rotate in a clockwise or counterclockwise direction depending on the direction of force applied to the flexing portion 150. As seen in FIGS. 2A and 2B, the flexing portion 150 may bend in either a clockwise or counterclockwise direction. The flexing portion 150 may be configured to return to the upright position when the force is removed from the flexing portion 150.

Figure 6:
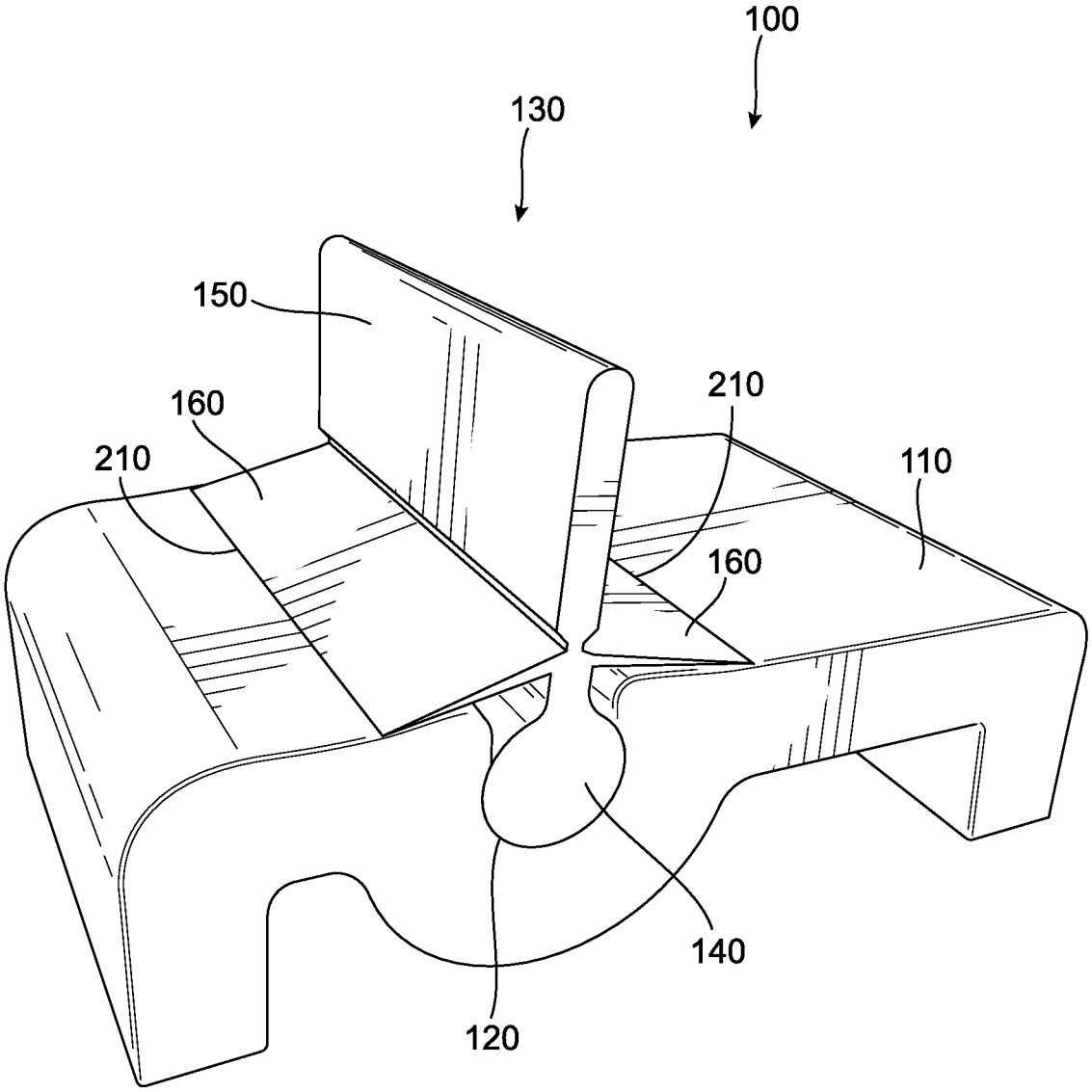
FIG. 6 is a perspective view of a shower dam assembly, shown in a normal position, according to an exemplary embodiment.

The shower dam 130 may include one or more sealing portions, shown as sealing portion 160. The sealing portion 160 may extend substantially perpendicular (e.g., 5 degrees, 10 degrees, 15 degrees, 20 degrees, etc.) from either the shower dam insert 140 or the flexing portion 150. In one example, the sealing portion 160 may be positioned proximate a midpoint between the shower dam insert 140 and the flexing portion 150. In another example, the sealing portion 160 may be positioned distal the midpoint between the shower dam insert 140 and the flexing portion 150. The sealing portion 160 may be configured to seal an area between the shower receptor and the shower dam 130. That is, the sealing portion 160 may be configured to press against the shower receptor to prevent water from flowing into an area defined by the shower dam 130. As can be appreciated, water may be able to enter into the area defined by the shower dam 130 when the sealing portion 160 is not pressed against the shower receptor. The sealing portion 160 may be tapered such that it is thicker near the edge at which it connects to the flexing portion 150 and the shower dam insert 140 and thinner near a distal edge 210. As seen in FIG. 6, the thickness of the sealing portion 160 at distal edge 210 may be less than the thickness of the sealing portion 160 near the edge at which the sealing portion 160 connects to the flexing portion 150 and the shower dam insert 140. The sealing portion 160 may form a ramp for an object to roll over the shower dam 130. For example, if a wheelchair rolls over the shower dam 130, the sealing portion 160 may act as a ramp to ease the process of entering a shower environment. In the embodiment in which the thickness of the sealing portion 160 tapers such that it is thicker near the edge at which it connects to the flexing portion 150 and the shower dam insert 140 and thinner near the distal edge 210, it may form a ramp that is more conducive to enable an object roll over the ramp. For example, having a lesser thickness near the distal edge 210 may ease the process of rolling a wheelchair over the shower dam 130 since there may be less material to have to roll over.

The shower dam 130 may include two sealing portions 160. The sealing portions 160 may be positioned opposite one another, where the sealing portions 160 intersect at the flexing portion 150. In other embodiments, the sealing portions 160 may intersect at a location distal the flexing portion 150. As can be appreciated, the sealing portions 160 may provide sealing to either side of the shower receptor. In other embodiments, the shower dam 130 may include more than two sealing portions 160 (e.g., three sealing portions 160, four sealing portions 160, five sealing portions 160, etc.). The thicknesses of the sealing portions 160 may taper as seen in FIG. 6. The thicknesses of the sealing portions 160 at distal edges 210 may be less than the thicknesses of the sealing portions 160 near the edges at which the sealing portions 160 connect to the flexing portion 150 and the shower dam insert 140. The variation in thicknesses may enable a user to have an easier and smoother entry and exit into the shower environment. For example, a wheelchair may more easily roll over the sealing portions 160 while entering and exiting the shower environment.

Figure 5:
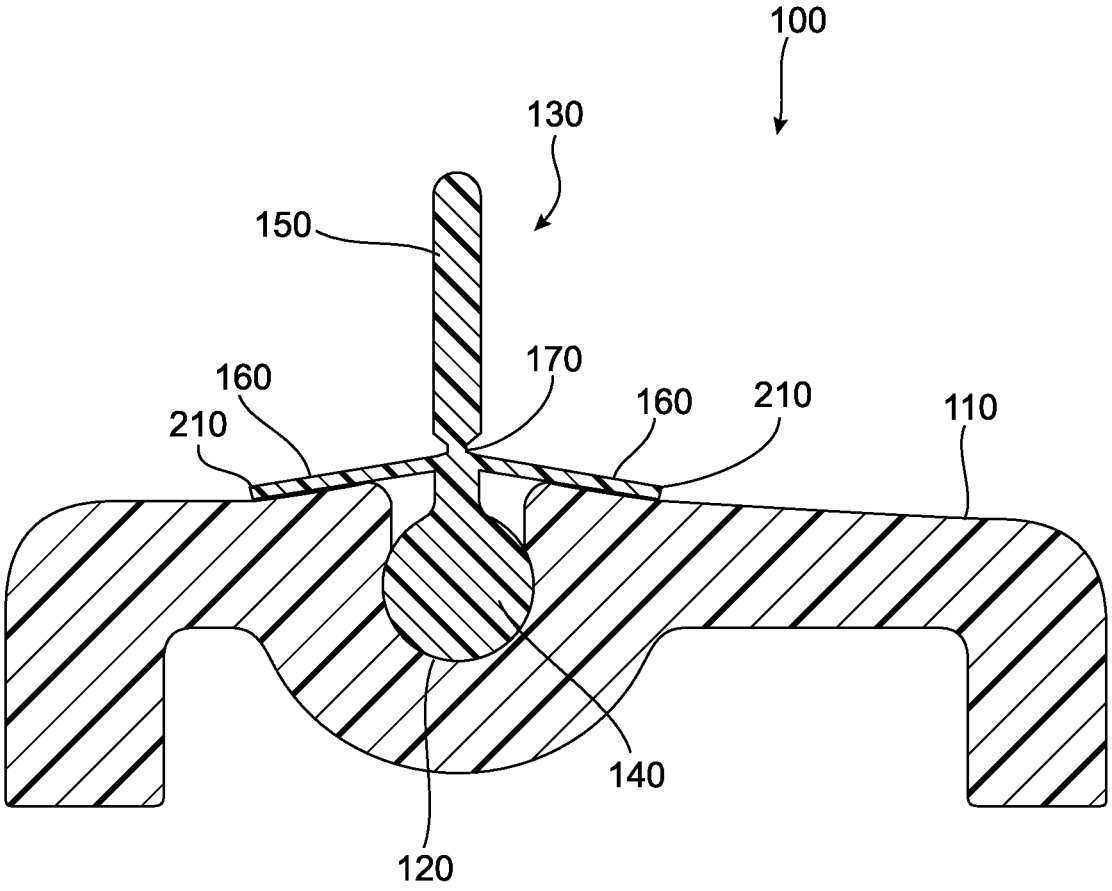
FIG. 5 is a cross-sectional view of the shower dam assembly of FIG. 1, according to an exemplary embodiment.

The shower dam 130 may be configured to flex about a location proximate an intersection between the two sealing portions 160 (e.g., the line along which the flexing portion 150 connects to the sealing portions 160). That is, the flexing portion 150 may be configured to flex about the location proximate the intersection between the two sealing portions 160, the flexing location 170 as seen in FIG. 5. The location at which the flexing portion 150 flexes, the flexing location 170, may have a thinner cross-section relative to the flexing portion 150. As can be appreciated, having this portion with a thinner cross-section may promote flexing of the flexing portion 150 at that location. Additionally or alternatively, the thinner cross-section may additionally allow for the flexing portion 150 to be flexed at a greater angle because there is less material to prevent movement of the flexing portion 150. By way of example, the flexing portion 150 may have a channel on each side of the flexing portion 150 to form the thinner cross-section. These channels may also define an axis at which the flexing portion 150 may flex relative to.

Figure 8:
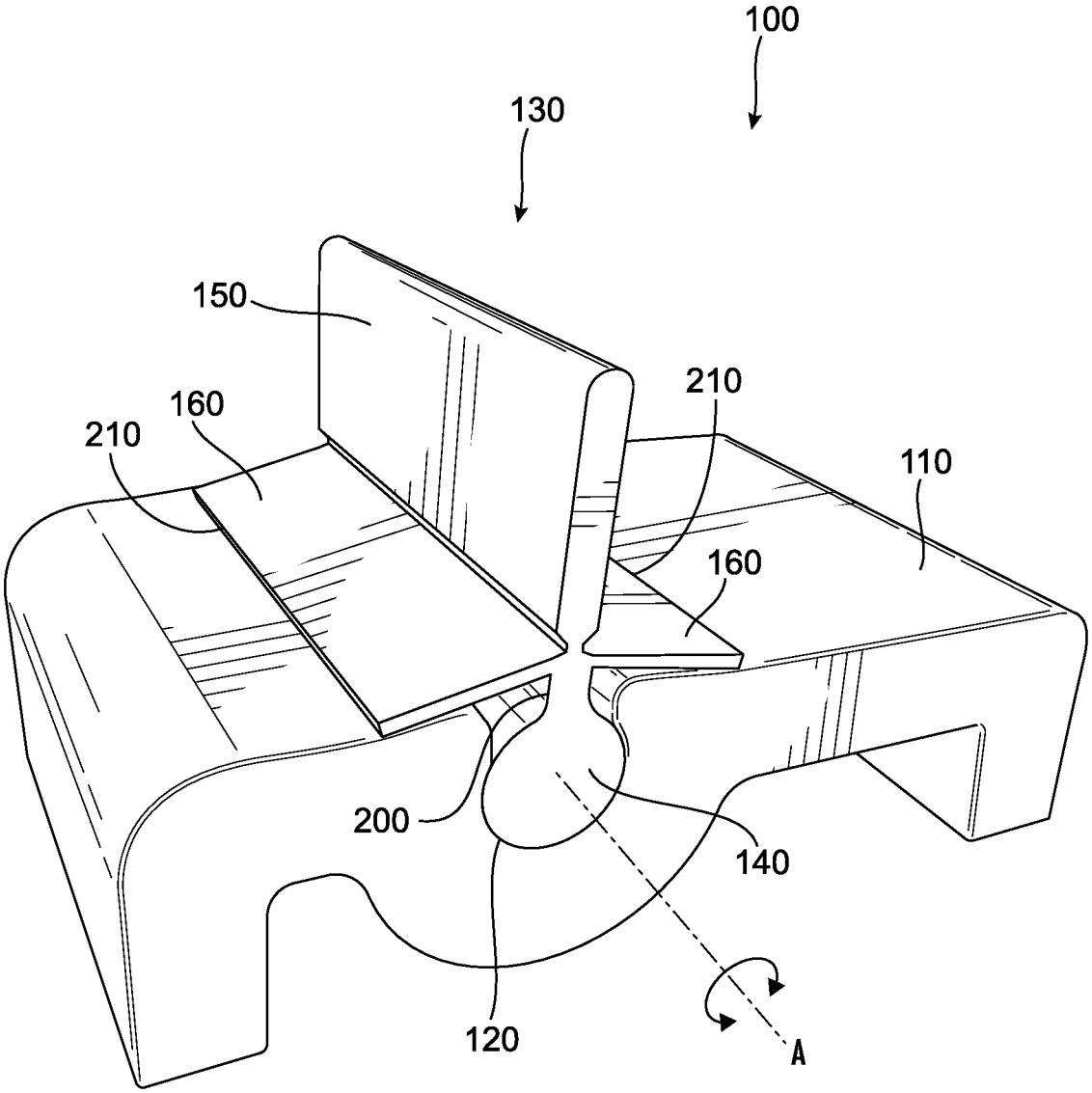
FIG. 8 is another perspective view of the shower dam assembly of FIG. 1, according to an exemplary embodiment.

The shower dam 130 may be configured to rotate within the groove 120. That is, the shower dam insert 140 may rotate within the groove 120. As seen in FIG. 8, the shower dam insert 140 may rotate within the groove 120 about an axis A. The shower dam insert 140 may rotate in both a clockwise and counterclockwise direction about axis A. The direction of rotation is dependent upon a direction of the force introduced to the shower dam 130. For example, if the shower dam 130 gets a force in a first direction, the shower dam insert 140 may rotate in a first direction. Accordingly, if the shower dam 130 gets a force in a second direction, the shower dam insert 140 may rotate in a second direction. As can be appreciated, rotation of the shower dam 130 within the groove 120 may substantially reduce an amount of stress on the flexing portion 150. The angle of rotation of the flexing portion 150 with the rotation of the shower dam 130 may be less than the angle of rotation of the flexing portion 150 without the rotation of the shower dam 130. Therefore, the rotation of the shower dam 130 may reduce the stress on the flexing portion 150. Since the stress on the flexing portion 150 may be reduced, the lifetime of the shower dam 130 may be increased. Additionally or alternatively, the rotation of the shower dam 130 may improve the user experience as the flexing portion 150 may form a ramp with an incline that is less steep than it may be without the rotation of the shower dam 130. The shower dam 130 may rotate a distance until the shower dam 130 abuts the shower base 110. As shown in FIGS. 2A, 2B, and 8, the shower dam 130 may include a corner cooperatively defined between the sealing portion 160 and the shower dam insert 140, proximate a shower dam connector 200, where the corner abuts an edge of the shower dam base 110 to define a maximum rotation threshold. In other embodiments, the shower dam insert 140 may rotate further than the maximum threshold.

As utilized herein, the terms "approximately," "relative to," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

It is important to note that the construction and arrangement of the shower dam assembly 100 and the systems and components thereof as shown in the various exemplary embodiments is illustrative only. Additionally, any element disclosed in one embodiment may be incorporated or utilized with any other embodiment disclosed herein. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A shower dam assembly for preventing or mitigating water egress from a shower receptor, the shower dam assembly comprising:
   - a shower dam base configured to be coupled to a threshold of the shower receptor and comprising a groove extending along at least a portion of the shower dam base; and
   - a shower dam comprising:
     - a shower dam insert configured to be received within the groove to removably couple the shower dam to the shower dam base; and
     - a flexing portion extending from the shower dam insert and configured to flex between a normal position in which the flexing portion extends at least partially upward from the shower dam insert and a flexed position in which the flexing portion extends from the shower dam insert at an angle relative to the normal position.

2. The shower dam assembly of claim 1, wherein an opening along a top of the groove is narrower than a width inside of the groove located below the opening.

3. The shower dam assembly of claim 1, wherein the shower dam insert is made of a flexible material that is configured to compress as the shower dam insert is moved into the groove and configured to expand once the shower dam insert is positioned in the groove in order to secure the shower dam insert within the groove.

4. The shower dam assembly of claim 1, wherein the flexing portion has a thinner cross section where the flexing portion connects to the shower dam insert.

5. The shower dam assembly of claim 1, wherein the flexing portion is further configured to flex between the normal position and a second flexed position in a direction opposite the flexed position.

6. The shower dam assembly of claim 1, wherein the flexed position is a substantially horizontal position.

7. The shower dam assembly of claim 1, wherein the flexing portion is configured to move into the flexed position when a force is applied to the flexing portion, and wherein the flexing portion is configured to return to the normal position when the force is removed from the flexing portion.

8. The shower dam assembly of claim 1, wherein the flexing portion is configured to elastically deform when moving into the flexed position and elastically recover when moving back into the normal position.

9. The shower dam assembly of claim 1, further comprising a sealing portion.

10. The shower dam assembly of claim 9, wherein the sealing portion is tapered such that it is thicker near an edge at which it connects to the flexing portion and the shower dam insert, and the sealing portion is thinner near a distal edge.

11. The shower dam assembly of claim 1, wherein the shower dam is configured to rotate relative to the shower dam base when a force is applied to the flexing portion.

12. A shower dam for preventing or mitigating water egress from a shower receptor, the shower dam comprising:

a shower dam insert configured to be received within a groove of a shower dam base to removably couple the shower dam to the shower dam base; and a flexing portion extending from the shower dam insert and configured to flex between a normal position in which the flexing portion extends at least partially upward from the shower dam insert along a plane that intersects with the shower dam insert and a flexed position in which the flexing portion extends from the shower dam insert at an angle relative to the normal position.

13. The shower dam of claim 12, wherein the shower dam base is fixedly attached to the shower receptor.

14. The shower dam of claim 12, wherein the shower dam base is integrated into the shower receptor.

15. The shower dam of claim 12, wherein an opening along a top of the groove is narrower than a width inside of the groove located below the opening, and wherein the shower dam insert is made of a flexible material that is configured to compress as the shower dam insert is moved into the groove and configured to expand once the shower dam insert is positioned in the groove in order to secure the shower dam insert within the groove.

16. The shower dam of claim 12, wherein the flexing portion has a thinner cross section where the flexing portion connects to the shower dam insert, wherein the flexing portion is further configured to flex between the normal position and a second flexed position in a direction opposite the flexed position, and wherein the flexed position is a substantially horizontal position.

17. The shower dam of claim 12, wherein the flexing portion is configured to move into the flexed position when a force is applied to the flexing portion, wherein the flexing portion is configured to return to the normal position when the force is removed from the flexing portion, and wherein the flexing portion is configured to elastically deform when moving into the flexed position and elastically recover when moving back into the normal position.

18. The shower dam of claim 12, further comprising a sealing portion, wherein the sealing portion is tapered such that it is thicker near an edge at which it connects to the flexing portion and the shower dam insert, and the sealing portion is thinner near a distal edge.

19. The shower dam of claim 12, wherein the shower dam is configured to rotate relative to the shower dam base.

20. A method of installing a shower dam assembly comprising:

attaching a shower dam base to a shower receptor;

pressing a shower dam insert into a groove of the shower dam base in a direction substantially perpendicular to a longitudinal axis of the groove; and causing the shower dam insert to compress or otherwise elastically deform when moving into the groove and recover when seated within the groove back to its original size and shape to securely hold the shower dam insert within the groove.

* * * * *